US011066766B2

(12) United States Patent
Nitschke et al.

(10) Patent No.: US 11,066,766 B2
(45) Date of Patent: Jul. 20, 2021

(54) MANUFACTURE OF SPUNBOND FROM CONTINUOUS FILAMENTS

(71) Applicant: Reifenhaeuser GmbH & Co. KG Maschinenfabrik, Troisdorf (DE)

(72) Inventors: Michael Nitschke, Koenigswinter (DE); Martin Neuenhofer, Roesrath (DE); Detlef Frey, Niederkassel (DE); Christine Noack, Cologne (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 138 days.

(21) Appl. No.: 16/420,253

(22) Filed: May 23, 2019

(65) Prior Publication Data

US 2019/0360140 A1 Nov. 28, 2019

(30) Foreign Application Priority Data

May 28, 2018 (EP) ..... 18174513

(51) Int. Cl.
*D04H 3/16* (2006.01)

(52) U.S. Cl.
CPC ..... *D04H 3/16* (2013.01)

(58) Field of Classification Search
CPC ..... D01D 5/088; D01D 5/0985; D01D 5/092; D04H 3/16
See application file for complete search history.

(56) References Cited

U.S. PATENT DOCUMENTS 4,820,142 A * 4/1989 Balk ..... D04H 3/02 348/97
2009/0026647 A1* 1/2009 Geus ..... B29C 48/05 264/40.6

* cited by examiner

*Primary Examiner* — Vishal I Patel
(74) *Attorney, Agent, or Firm* — Andrew Wilford

(57) ABSTRACT

An apparatus for making spunbonded nonwoven from continuous thermoplastic filaments has a spinneret for downwardly emitting the continuous filaments in a filament direction, a cooling chamber directly beneath the spinneret for receiving the filaments from the spinneret and cooling the spun filaments with cooling air and having relative to a longitudinally extending machine direction a pair of longitudinal sides extending parallel to the machine direction and a pair of transverse sides extending substantially perpendicular to the machine direction between the longitudinal sides. Respective air-supply manifolds on the transverse sides feed cooling air therefrom into the cooling chamber. The cooling air is extracted from the cooling chamber at the longitudinal sides. A stretcher directly beneath the cooling chamber receives and elongates the cooled filaments, and a device deposits the stretched filaments as a band and conveys the band off in the machine direction.

11 Claims, 4 Drawing Sheets

MANUFACTURE OF SPUNBOND FROM CONTINUOUS FILAMENTS

FIELD OF THE INVENTION

The present invention relates to making spunbond. More particularly this invention concerns a method and apparatus making spunbond from continuous filaments.

BACKGROUND OF THE INVENTION

An apparatus for making spunbonded nonwoven from continuous filaments, particularly from continuous thermoplastic filaments, has a spinneret that emits the continuous filaments in a downward filament direction, a cooling chamber for cooling the spun filaments with cooling air, a stretcher for elongating the filaments, and a device for depositing the filaments and conveying them off in a machine direction (MD).

In the context of the invention, "spunbonded nonwoven" refers particularly to a spunbond fabric that is made by the spunbond process. Continuous filaments differ from staple fibers on account of their quasi endless length, whereas staple fibers have substantially shorter lengths of for example from 10 mm to 60 mm.

Here and in the following, the longitudinal "machine direction" (MD) means the horizontal direction in which the filaments deposited to form a nonwoven band are carried off by a mesh belt or the like acting as a conveyor. In a known spunbond apparatus, the cooling chamber and the stretcher generally are elongated transversely to the machine direction (MD) and thus in the so-called CD direction. The CD/transverse walls of the cooling chamber and the stretcher facing the filament flow are usually substantially longer in the CD direction than the longitudinal walls extending in the MD direction. The cooling air supply in the cooling chamber usually is introduced through the long transverse walls extending in the CD direction (CD walls) flanking the filament flow.

Various embodiments of an apparatus and method of the described system are inherently known from practice. The known apparatus and method have the disadvantage that the spunbonded nonwoven made by them are not always sufficiently homogeneous or uniform over their surfaces. Frequently, the spunbonded nonwoven made have objectionable inhomogeneities in the form of imperfections or defects. Such inhomogeneities can be observed above all at the edges of the deposited band of filaments. These defects are apparently due to instabilities in the filament guidance at the edges. This results in a thinned and highly irregular deposited filament mass in this edge region. As a result of transient filament movements at the edges, mutual contact of the filaments can also occur, which can lead to yarn breakage. In the case of such yarn breakage, the beginning of the subsequent new filament in the deposited filament band is visible because the yarn portion was not subjected to the same speed and is therefore substantially thicker than the surrounding filaments in the deposited filament band. Often, the yarn portion is not sufficiently cooled and can consequently stick to the tray or to the mesh belt.

Mutual contact among the filaments also produces so-called "drops" at the edges of the deposited nonwoven band, which cause serious disturbances. The drops are formed as a result of the contacting of a plurality of filaments that become visible as a mass accumulation on deposited filament band or on the mesh belt. This results in adhesions in the deposited nonwoven band that may adhere to the tray or even to the rollers that contact the deposited nonwoven band. These imperfections are torn out during the transfer of the nonwoven to a calender, thus creating unwanted holes in the spunbonded nonwoven. For these reasons, the deposited nonwoven band is in need of improvement in its edge region and/or near the MD/longitudinal side walls.

OBJECTS OF THE INVENTION

It is therefore an object of the present invention to provide an improved method and apparatus for making spunbond from continuous filaments.

Another object is the provision of such an improved method and apparatus for making spunbond from continuous filaments that overcomes the above-given disadvantages, in particular with which inhomogeneities or defects of the deposited filament band at the edges and/or in the MD region can be prevented or at least largely minimized.

SUMMARY OF THE INVENTION

An apparatus for making spunbonded nonwoven from continuous thermoplastic filaments has according to the invention a spinneret for downwardly emitting the continuous filaments in a filament direction, a cooling chamber directly beneath the spinneret for receiving the filaments from the spinneret and cooling the spun filaments with cooling air and having relative to a longitudinally extending machine direction a pair of longitudinal sides extending parallel to the machine direction and a pair of transverse sides extending substantially perpendicular to the machine direction between the longitudinal sides. Respective air-supply manifolds on the transverse sides feed cooling air therefrom into the cooling chamber. The cooling air is extracted from the cooling chamber at the longitudinal sides. A stretcher directly beneath the cooling chamber receives and elongates the cooled filaments, and a device deposits the stretched filaments as a band and conveys the band off in the machine direction.

In other words, according to the invention, cooling air or process air is extracted from the cooling chamber at the side walls (MD/longitudinal side walls) and/or short end walls of the cooling chamber. It lies within the scope of the invention for cooling air to be removed from the cooling chamber at the two side walls (MD/longitudinal side walls) of the cooling chamber extending parallel to the machine direction (in the MD direction). Advantageously, the air discharge occurs along the height or the vertical extent of an MD/longitudinal side wall of the cooling chamber and preferably over the full height or over the entire vertical extent of an MD/longitudinal side wall of the cooling chamber or at a plurality of points or discharge points that are distributed over the height or the vertical extent of an MD/longitudinal side wall of the cooling chamber.

In this respect, the invention is initially based on the discovery that, in order to improve the homogeneity of the deposited nonwoven band at the edges or near the MD/longitudinal side walls of the apparatus, influencing the cooling air flow in these edge regions is advantageous and advantageous. Filament movements can be influenced such that a uniformity of the deposited filament band is achieved. It is also assumed that a separation of the air flow in the case of a cross-sectional enlargement in the CD direction can be effectively prevented by virtue of the air discharge according to the invention on the MD/longitudinal side walls, so that uniform filament guidance can be maintained. The invention is further based on the discovery that extracting of the cooling air at the end walls or MD/longitudinal side walls is a relatively simple measure with which the object nonetheless can be attained in an efficient and functionally reliable manner. Furthermore, the invention is based on the discovery that any end-wall entry of air near a monomer extraction between spinneret and cooling chamber or near the stretcher and/or near the diffuser is not advantageous, but rather that it actually affects the cooling air in the vicinity, more particularly in the vertical level of the cooling chamber. It is of particular importance that the measures according to the invention of the end wall extraction of cooling air have proven to be advantageous even at high throughputs of greater than 150 kg/h/m, greater than 200 kg/h/m, and even greater than 250 kg/h/m. In the production of filaments from polyolefins, particularly from polypropylene, the measures according to the invention have been found to be advantageous at yarn speeds of greater than 2000 m/min. In the production of filaments from polyester, particularly from polyethylene terephthalate (PET), the measures according to the invention have been found to be advantageous at high yarn speeds of from 4000 to 5000 m/min or even of greater than 5000 m/min.

One very especially preferred embodiment of the invention is characterized in that the apparatus according to the invention is set up with the understanding that, on at least one MD/longitudinal side wall, preferably on both MD/longitudinal side walls, a continuous extraction or a substantially continuous extraction of the cooling air will take place.

It is recommended that at least one, preferably both of the MD/longitudinal side walls of the cooling chamber extending parallel to the machine direction, be respectively delimited by at least one side wall and/or by at least one side-wall door. The extraction of cooling air then takes place near the side wall and/or side-wall door or through the side wall and/or through the side-wall door. It lies within the scope of the invention for a side wall or a side-wall door to have transparent regions through which the yarn or filament movement can be inspected from the outside wall.

According to the recommended embodiment of the invention, at least one opening or a plurality of openings is provided in at least one side wall and/or in at least one side-wall door of the MD/longitudinal side walls, with cooling air being extracted from the cooling chamber via the MD/longitudinal side walls through this at least one opening or through these openings. One preferred embodiment of the invention is characterized in that at least one permeable or semipermeable region or a plurality of permeable or semipermeable regions is provided in at least one side wall and/or in at least one side-wall door of the MD/longitudinal side walls, with cooling air being extracted from the cooling chamber via the MD/longitudinal side walls through these permeable and/or semipermeable regions. One embodiment of the invention that has been found to be especially advantageous is characterized in that openings and/or permeable or semipermeable regions are distributed over the height of at least one side wall and/or over the height of at least one side-wall door and preferably over the height of both side wall walls or both side-wall doors. If openings are provided in a side wall and/or a side-wall door, these are advantageously at least 5, preferably at least 10, and especially preferably at least 15 in number. The openings can be embodied in the form of holes, columns, and the like. According to a very preferred embodiment of the invention, the embodiments described above are made with the openings and/or with the permeable or semipermeable regions on both MD/longitudinal side walls or on both side wall walls or side-wall doors of the cooling chamber.

According to a highly recommended embodiment of the invention, permeable or semipermeable regions are formed in the edge profiles of at least one side-wall door, preferably of both side-wall doors, and/or openings are formed.

One embodiment of the invention that has proven to be very advantageous is characterized in that at least one MD/longitudinal side wall has, and preferably both MD/longitudinal side walls have at least one air-conducting element, preferably a plurality of air-conducting elements for guiding the cooling air to be extracted. A recommended embodiment of the invention is characterized in that the edge profiles of at least one side-wall door, preferably of both side-wall doors are air-conducting elements.

It lies within the scope of the invention for a pressure gradient or a sufficient pressure gradient to be present near the MD/longitudinal side walls so that cooling air can flow out of the MD/longitudinal side walls. One preferred embodiment of the invention is characterized in that the extraction of the cooling air from the cooling chamber via the MD/longitudinal side walls of the cooling chamber occurs passively. In this case, the apparatus is set up with the understanding that, due to an overpressure in the cooling chamber, cooling air can be extracted through at least one MD/longitudinal side wall, preferably through both MD/longitudinal side walls, of the cooling chamber. Moreover, a preferred embodiment of the invention is characterized in that active extraction of cooling air from the cooling chamber occurs via at least one MD/longitudinal side wall. In this preferred embodiment, at least one blower is provided that can aspirate the cooling air from the cooling chamber through at least MD/longitudinal side wall of the cooling chamber.

It lies within the scope of the invention for the apparatus according to the invention to be designed with the understanding that a quantity of cooling air of from 1 to 400 $m^3/h$, preferably from 2 to 350 $m^3/h$ and particularly from 5 to 350 $m^3/h$ can be extracted from one MD/longitudinal side wall of the cooling chamber, preferably on each of the two MD/longitudinal side walls of the cooling chamber. Especially preferably, a quantity of cooling air of from 10 to 300 $m^3/h$, particularly from 25 to 250 $m^3/h$, and very preferably from 30 to 200 $m^3/h$ can be extracted from one MD/longitudinal side wall or on each of the two MD/longitudinal side walls of the cooling chamber.

It also lies within the scope of the invention for a regulation or throttling of the extracted cooling-air stream to take place as a function of the amount of yarn and/or of the filament position and/or of the filament movement near the MD/longitudinal side walls. The yarn amount and/or the filament movement near the MD/longitudinal side walls can thus be observed and the regulation or throttling of the extracted cooling-air stream adjusted until the filament bundle no longer exhibits any unwanted movements. Observation can be performed particularly through transparent regions in the side-wall doors of the apparatus. Advantageously, the extracted cooling-air streams on the two MD/longitudinal side walls are controlled or throttled separately.

According to an especially preferred embodiment of the invention, a semiautomatic or automatic regulation or throttling of the cooling-air stream extracted from the MD/longitudinal side walls occurs. In this regard, it lies within the scope of the invention for the cooling-air stream that is extracted from at least one MD/longitudinal side wall, preferably on both MD/longitudinal side walls, to be regulated or throttled as a function of at least one measurement parameter. According to a design variant, the pressure in the cooling chamber can be regulated or throttled as a function of at least one measurement parameter, and then a quasi passive extraction of a cooling-air stream occurs, advantageously against a permanently set throttling, due to the pressure, more particularly overpressure in the cooling chamber. One design variant is characterized in that at least one extraction fan for extracting the cooling-air stream controlled with or without feedback on at least one MD/longitudinal side wall, preferably on both MD/longitudinal side walls, as a function of at least one measurement parameter (active extraction of cooling air). The at least one measurement parameter is particularly the throughput of the apparatus and/or the plastic selected for the filaments and/or the melt temperature and/or the air temperature and/or the stream in the cooling chamber and/or the pressure in the cooling chamber. The above-described regulation or throttling of the cooling-air stream, which is extracted via the MD/longitudinal side wall or the MD/longitudinal side walls of the cooling chamber, then occurs as a function of the measured measurement parameter.

A recommended regulation or throttling of the extracted cooling-air stream is characterized in that the filaments or the filament movement at the edges at the MD/longitudinal side walls are/is detected by a camera or the like. The required cooling-air stream to be extracted can be calculated, set, and regulated either as a function of the filament movement or, if appropriate lighting exists, of a brightness distribution. Corresponding camera images or camera evaluations can also be displayed on a control panel, making it possible to control or regulate the extracted cooling-air stream from there. Another embodiment of the invention is characterized in that the deposited nonwoven band is observed or measured and evaluated at its edges on the MD/longitudinal side walls, and that the required cooling-air stream to be extracted is set and/or regulated as a function of the evaluation results. It lies within the scope of the invention for the apparatus according to the invention to have at least one controller operating with or without feedback and with which the cooling-air stream extracted through the at least one MD/longitudinal side wall or through the MD/longitudinal side walls can be controlled with or without feedback and/or throttled.

According to one embodiment of the invention, the cooling-air streams extracted via the two MD/longitudinal side walls can be the same or substantially the same. However, it also lies within the scope of the invention for differently sized cooling-air streams to be extracted from the two MD/longitudinal side walls. Another embodiment of the invention is characterized in that different cooling-air discharge takes place and/or different cooling-air streams are extracted over the height or over the vertical extent of the cooling chamber. Different discharge profiles thus arise in this embodiment over the height or over the vertical extent of the cooling chamber.

In the following, a recommended embodiment of a spunbond apparatus used in the invention will be described. According to the invention, the continuous filaments are spun by a spinneret and fed to the cooling chamber in order to cool the filaments with cooling air. It lies within the scope of the invention for at least one spinning beam for spinning the filaments to extend transverse to the machine direction (MD direction). According to a very preferred embodiment of the invention, the spinning beam extends perpendicular or substantially perpendicular to the machine direction. It is however also possible and lies within the scope of the invention for the spinning beam to be extend at an acute angle to the machine direction. A preferred embodiment of the invention is characterized in that at least one monomer extractor is provided between the spinneret and the cooling chamber. With this monomer extractor, air is sucked out of the filament formation region below the spinneret. In this way, the gases emanating from the continuous filaments, such as monomers, oligomers, decomposition products, and the like, can be removed from the apparatus. A monomer extractor preferably has at least one extraction chamber to which the advantageously at least one extraction blower is connected. It lies within the scope of the invention for the cooling chamber to be connected to the air supply manifolds provided thereon for supplying the cooling air in the direction of flow of the filaments to the monomer extractor. The cooling air is fed into the cooling chamber from these air supply manifolds extending in the CD direction (transverse to the machine direction). The inventive extraction of cooling air from the cooling chamber takes place via the MD/longitudinal side walls of the cooling chamber parallel to and thus in the MD direction. These MD/longitudinal side walls of the cooling chamber are advantageously shorter or substantially shorter than the CD/transverse side walls of the cooling chamber along which the two oppositely situated air supply manifolds of the cooling chamber extend.

According to a preferred embodiment of the invention, the air supply manifolds can each be subdivided into two or more compartments provided one above the other from which cooling air of different temperature can be preferably supplied. It is recommended that cooling air be fed into the cooling chamber via two opposing compartments of the air supply manifolds at a temperature $T_1$ and that cooling air be fed into the cooling chamber via two opposing compartments of the two air supply manifolds provided beneath these at a temperature $T_2$ different from temperature $T_1$. It lies within the scope of the invention for an inventive extraction of cooling air to take place on the MD/longitudinal side walls near each compartment of the supply manifolds.

It lies within the scope of the invention for the filaments to be fed from the cooling chamber into a stretcher for elongating the filaments. Advantageously, an intermediate passage adjoins the cooling chamber and connects the cooling chamber to a tunnel of the stretcher. One very especially preferred embodiment of the invention is characterized in that the subassembly of the cooling chamber and the stretcher or the subassembly of the cooling chamber, the intermediate passage, and the tunnel is a closed system. "Closed system" means particularly that, apart from the addition of cooling air into the cooling chamber, no further air is introduced into this subassembly. In terms of attaining the inventive object, the inventive extraction of the cooling air through the MD/longitudinal side walls of the cooling chamber has been found to be especially advantageous in combination with the preferred closed subassembly. Especially homogeneous and defect-free nonwoven edges are achieved of the filament band using this combination in particular. This is especially true if the extraction of cooling air is done through the MD/longitudinal side walls of the cooling chamber at locations above the height of the MD/longitudinal side walls, and above all if there is cooling-air extraction both in the upper half of the MD/longitudinal side walls and the lower half of the MD/longitudinal side walls of the cooling chamber.

According to a recommended embodiment of the invention, at least one diffuser through which the filaments are guided is connected to the downstream end of the stretcher in the direction of flow of the filaments. This diffuser advantageously comprises a diffuser cross section that becomes larger in the direction of the filament placement area or a divergent diffuser section. It lies within the scope of the invention for the filaments to be deposited on a device for depositing filaments or for depositing nonwoven. Advantageously, the deposition device is a mesh belt or an air-permeable mesh belt. The nonwoven web formed from the filaments is transported away in the machine direction (MD) with this deposition device or with this mesh belt. It is recommended that process air be sucked through the deposition device or through the mesh belt, more particularly sucked from below through the mesh belt in the area in which the filaments are deposited. An especially stable depositing of the filament or nonwoven can be achieved as a result. This extraction is also of particular importance in combination with the inventive extraction of cooling air on the MD/longitudinal side walls of the cooling chamber. After deposition on the deposition device, the deposited filament band or the nonwoven web is advantageously conveyed for additional treatment measures, particularly calendering.

One highly recommended embodiment of the invention is characterized in that a flow straightener is provided on the cooling chamber side wall in at least one air supply manifold, preferably in both air supply manifolds of the cooling chamber through which the cooling air flows before entering the cooling chamber. The flow straighteners serve to homogenize the cooling-air flow incident on the filaments. It lies within the scope of the invention for a flow straightener to have a plurality of flow passages oriented perpendicular to the filament flow. These flow passages are each advantageously delimited by passage walls and are preferably straight. It has proven advantageous if the free-flowable open surface area of each flow straightener constitutes greater than 90% of the total area of the flow straightener. "Free-flowing open surface area of the flow straightener" refers to the surface through which the cooling air can freely flow and is not obstructed by the passage walls or by any spacers that may be provided between the flow passages. Preferably, the ratio of the length L of the flow passages to the smallest inner diameter $D_i$ of the flow passages lies in the range between 1 and 10, advantageously in the range between 1 and 9. For example, the flow passages can have a polygonal cross section, particularly a hexagonal cross section. However, they can also be round, for example circular, in cross section. The term "smallest inner diameter $D_i$" refers here and below to the smallest inner diameter measured in a flow passage of the flow straightener if this flow passage has different inner diameters with respect to its cross section. Thus, in the case of a cross section in the form of a regular hexagon, the smallest inner diameter $D_i$ is measured between two opposite side walls and not between two opposite corners. If the smallest inner diameter varies in the different flow passages, the smallest inner diameter $D_i$ refers particularly to the smallest inner diameter or mean smallest inner diameter, averaged with respect to the plurality of flow passages.

According to one embodiment of the invention, the cooling air extracted from at least one MD/longitudinal side wall, preferably from both MD/longitudinal side walls, of the cooling chamber, can be fed into the monomer extractor. The at least one extraction fan connected to the monomer extractor can be used for this purpose. In this embodiment, the extracted cooling air is preferably passed through a filter system that is provided in the monomer extractor. Alternatively or in addition, the cooling air extracted from an MD/longitudinal side wall or from the MD/longitudinal side walls of the cooling chamber can be fed into the intermediate passage and/or into the diffuser and/or into the extraction beneath the deposition device. These discharges can create a pressure gradient that is sufficient for extracting the cooling air from the cooling chamber.

To attain the inventive object, the invention also teaches a method of making spunbonded nonwoven from continuous filaments, particularly from continuous thermoplastic filaments, where the continuous filaments are spun out and then cooled in a cooling chamber, and air for cooling the filaments is fed into the cooling chamber via two opposing side walls that extend transverse to the machine direction (in the CD direction), and the cooling air is extracted from the cooling chamber from at least one of the side walls (MD/longitudinal side walls) controlled with or without feedback to the machine direction, preferably on both MD/longitudinal side walls.

It has already been pointed out that, according to a recommended embodiment, the cooling-air stream extracted through the at least one MD/longitudinal side wall, preferably the cooling-air stream extracted through both MD/longitudinal side walls, is controlled with or without feedback and/or throttled. The cooling-air stream extracted through the at least one MD/longitudinal side wall, preferably through both MD/longitudinal side walls, is advantageously regulated or throttled as a function of the filament state, more particularly of the filament bundle state, near the MD/longitudinal side wall and/or near the MD/longitudinal side walls. Furthermore, it lies within the scope of the invention that each of the cooling-air streams can be extracted separately through the two MD/longitudinal side walls in a controlled and/or throttled manner. In the context of the method according to the invention, the cooling air extracted through at least one MD/longitudinal side wall, preferably through both MD/longitudinal side walls, of the cooling chamber, can be fed into a monomer extractor provided between spinneret and cooling chamber and/or into the process stream below the cooling chamber and/or into the stretcher and/or into a diffuser provided between the stretcher and deposition device and/or into the extractor below the deposition device.

A recommended embodiment of the invention is characterized by operation at throughputs of over 150, preferably over 200 kg/h/m and even over 250 kg/h/m. The throughputs in the context of the method according to the invention are advantageously 150 to 300 kg/h/m. It lies within the scope of the invention for a yarn speed and/or filament speed of greater than 2000 m/min to be used in the method according to the invention in the course of the manufacture of filaments or spunbonded nonwoven from polyolefins, particularly from polypropylene. It also lies within the scope of the invention for a yarn speed and/or a filament speed of greater than 4000 m/min, particularly of greater than 5000 m/min, to be used in the method according to the invention in the course of the manufacture of filaments or spunbonded nonwoven from polyester, particularly from polyethylene terephthalate (PET). The measures according to the invention have been found to be advantageous even and above all at the high throughputs and high yarn speeds cited above. Here as well, very stable, compact, and homogeneous edge deposits of the nonwoven can be obtained.

The invention is based on the discovery that, with the apparatus according to the invention and with the method according to the invention, spunbonded nonwoven of optimal quality and very homogeneous characteristics can be made. In contrast to many measures that are known from practice and from the prior art, homogeneous nonwoven are possible that virtually have no defects, above all at the edges (on the MD/longitudinal side walls) of the deposited filament band. The deposited nonwoven bands made according to the invention have a uniform or substantially uniform weight per unit area over their width and particularly in their edge regions as well. By virtue of the fact that a preferred direction of flow is quasi imposed upon the air, more particularly cooling air, in the MD regions, a very stable, compact, and uniform edge region can be achieved. The apparatus according to the invention and the method according to the invention are also suitable for high filament speeds and high throughputs. Here as well, outstanding homogeneous properties of the nonwoven web can be achieved over the entire width of the nonwoven web and thus also at the edges. The inventive extraction of cooling air near the MD/longitudinal side walls of the cooling chamber has a very positive influence on the filament flow, and any adjustments of the cooling-air stream to be extracted can be made in a simple and non-laborious manner. It should be emphasized, above all, that the drops that can be observed at the edges of the nonwoven web with many known measures can be prevented or at least largely minimized. In addition, it should be emphasized that the stated advantages can be achieved through relatively simple measures and using an apparatus having an inexpensive construction. Compared to the apparatuses known hitherto, little or no additional hardware is needed in order to implement the measures according to the invention. This applies above all to the passive extraction of cooling air due to the overpressure in the cooling chamber. It should also be emphasized that the invention can be adjusted in a simple and non-laborious manner to different working widths of the nonwoven web deposit.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
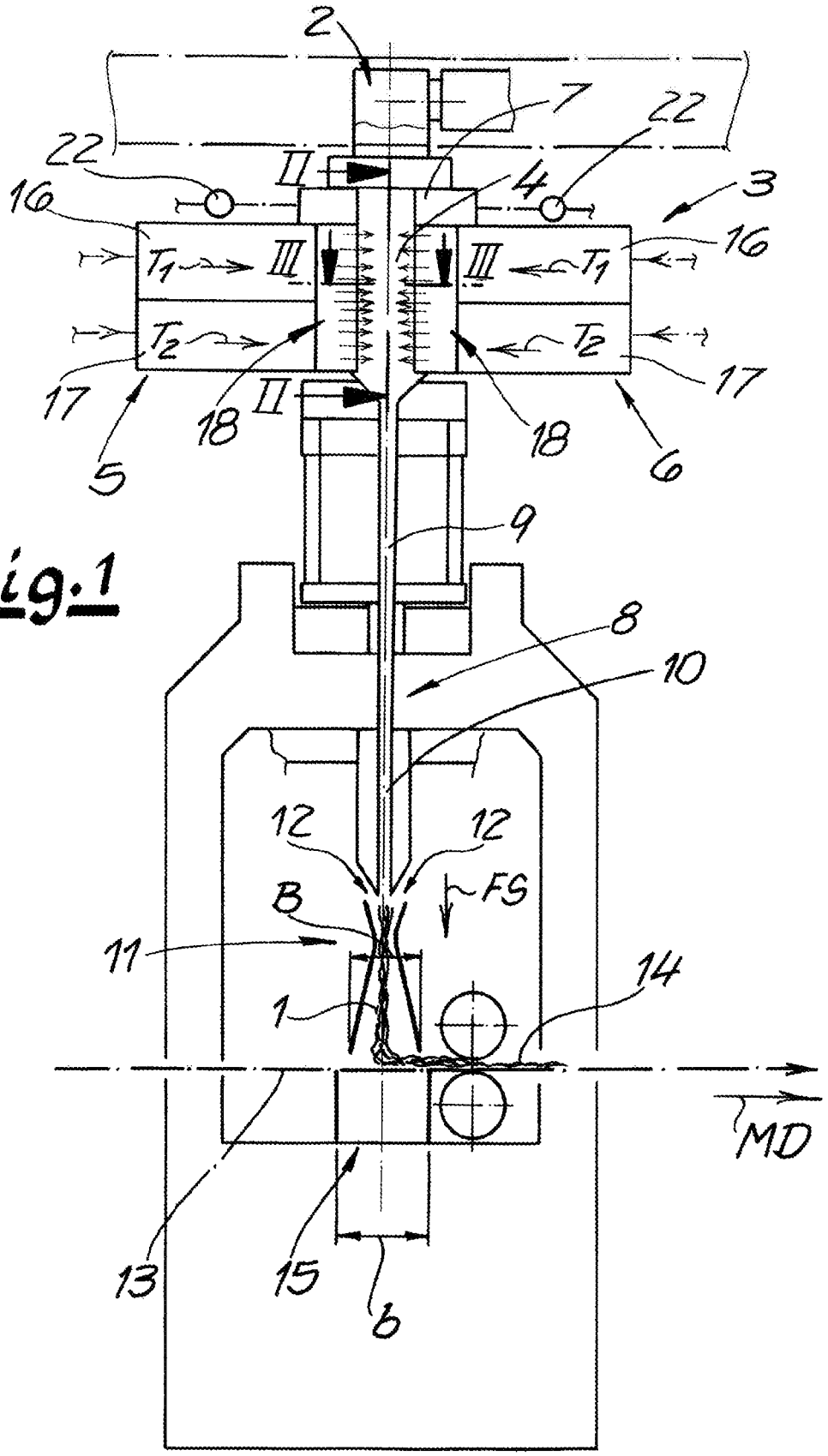
FIG. 1 is a vertical section through the apparatus according to the invention, FIG. 2 section II-II through the object of FIG. 1.

The drawing shows an apparatus according to the invention for making spunbonded nonwoven and that has a spinneret 2 for spinning continuous filaments 1 that are fed into a cooler 3 with a cooling chamber 4 and air supply manifolds 5, 6 provided on two opposite side walls of the cooling chamber 4. The cooling chamber 4 and the air supply manifolds 5, 6 have a long width dimension extending transverse to the machine direction MD and thus in the CD direction of the apparatus, which here is perpendicular to the view plane of FIG. 1. Cooling air is fed from the oppositely situated air supply manifolds 5, 6 into the cooling chamber 4. A flow straightener 18 is provided in each of the two air supply manifolds 5, 6 on the cooling chamber side wall through which the cooling air flows before entering the cooling chamber 4.

A monomer extractor 7 is provided between the spinneret 2 and the cooler 3 and pulls gases occurring during the spinning process from the apparatus. These gases can be monomers, oligomers, or decomposition products and similar substances, for example. The monomer extractor 7 has a fan 22 for extracting the objectionable gases.

The air supply manifolds 5, 6 with their flow straighteners 18 extend transverse to the machine direction MD along CD/transverse side walls 24 of the cooling chamber 4. Cooling air is supplied to the cooling chamber 4 from the air supply manifolds 5, 6 through the CD/transverse walls. According to the invention, cooling air is extracted at the end walls or on MD/longitudinal side walls 25 of the cooling chamber. These cooling-air streams are shown particularly in FIG. 3 by arrows. The discharge of cooling air through the MD/longitudinal side walls 25 will be explained in greater detail below. The end walls or the MD/longitudinal side walls 25 of the cooling chamber 4 are the short side walls of the cooling chamber 4, which are particularly substantially shorter than the CD/transverse walls 24. According to a design variant, side-wall doors 23 are provided on the MD/longitudinal side walls 25 of the cooling chamber 4.

Down in the filament flow direction FS from the cooler 3 is a stretcher 8 in which the filaments 1 are elongated. The stretcher 8 has an intermediate passage 9 that connects the cooler 3 to a tunnel 10 of the stretcher 8. According to an especially preferred embodiment, the subassembly of the cooler 3 and the stretcher 8 and/or the subassembly of the cooler 3, the intermediate passage 9, and the tunnel 10 are a closed system. "Closed system" means particularly that, apart from the supply of cooling air in the cooler 3, no further air is fed into this subassembly. This closed system has proven to be particularly advantageous in connection with the inventive extraction of cooling air through the MD/longitudinal side walls 25 of the apparatus.

A diffuser 11 through which the filaments 1 are guided is downstream of the stretcher 8 in the direction of filament flow FS. According to a recommended embodiment, secondary air inlet gaps 12 are provided between the stretcher 8 and/or between the tunnel 10 and the diffuser 11 for the introduction of secondary air into the diffuser 11. After passing through the diffuser 11, the filaments are deposited on a deposition device that is a mesh belt 13. The deposited filament band or the nonwoven web 14 is then conveyed or transported away by the mesh belt 13 in the machine direction MD. Advantageously, an extractor for sucking air or process air through the mesh belt 13 is provided beneath the deposition or conveying device or beneath the mesh belt 13. For this purpose, an extraction region 15 is preferably provided beneath the mesh belt 13 and here beneath the diffuser outlet. Preferably, the extraction region 15 extends at least over a width B of the diffuser outlet. Recommendably, a width b of the extraction region 15 is greater than the width B of the diffuser outlet.

According to a preferred embodiment, each air supply manifold 5, 6 is divided into two compartments 16, 17, from which cooling air of different temperatures can be fed into the cooling chamber 4. In this embodiment, cooling air can be supplied from each of the upper compartments 16 at a temperature $T_1$, whereas cooling air can be supplied from each of the two lower compartments 17 at a temperature $T_2$ different from the temperature $T_1$. The air supply manifolds 5, 6 can also be subdivided into more than two manifold sections 16, 17 that are provided one above the other and from which cooling air of different temperature is advantageously supplied. This subdivision of the air supply manifolds 5, 6 and the inflow of cooling air of different temperatures is also of particular importance in combination with the inventive extraction of cooling air via the MD/longitudinal side walls 25. In this embodiment, very homogeneous edge portions of the deposited nonwoven band are formed, producing a very stable and compact edge of the nonwoven web 14*h*.

Figure 2:
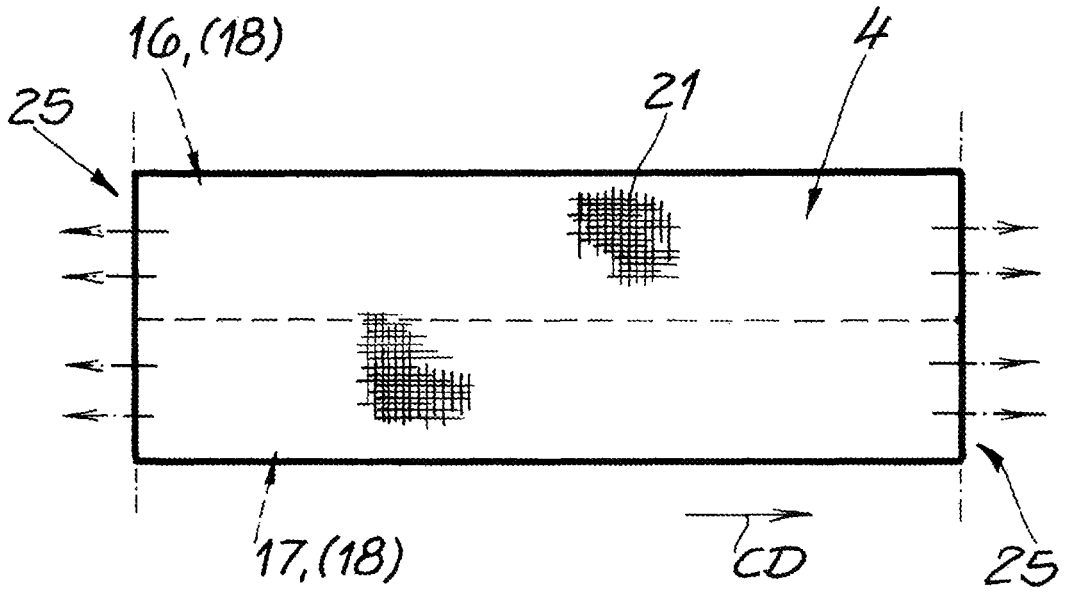
Figure 3:
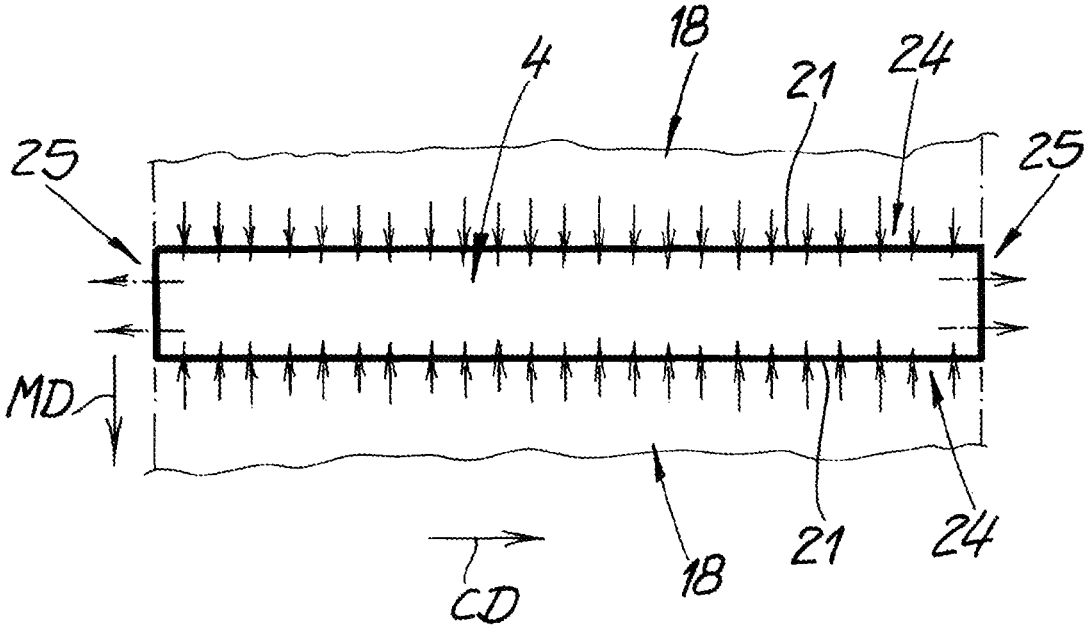
FIG. 3 is cross section through the apparatus of FIG. 1.
Figure 4:
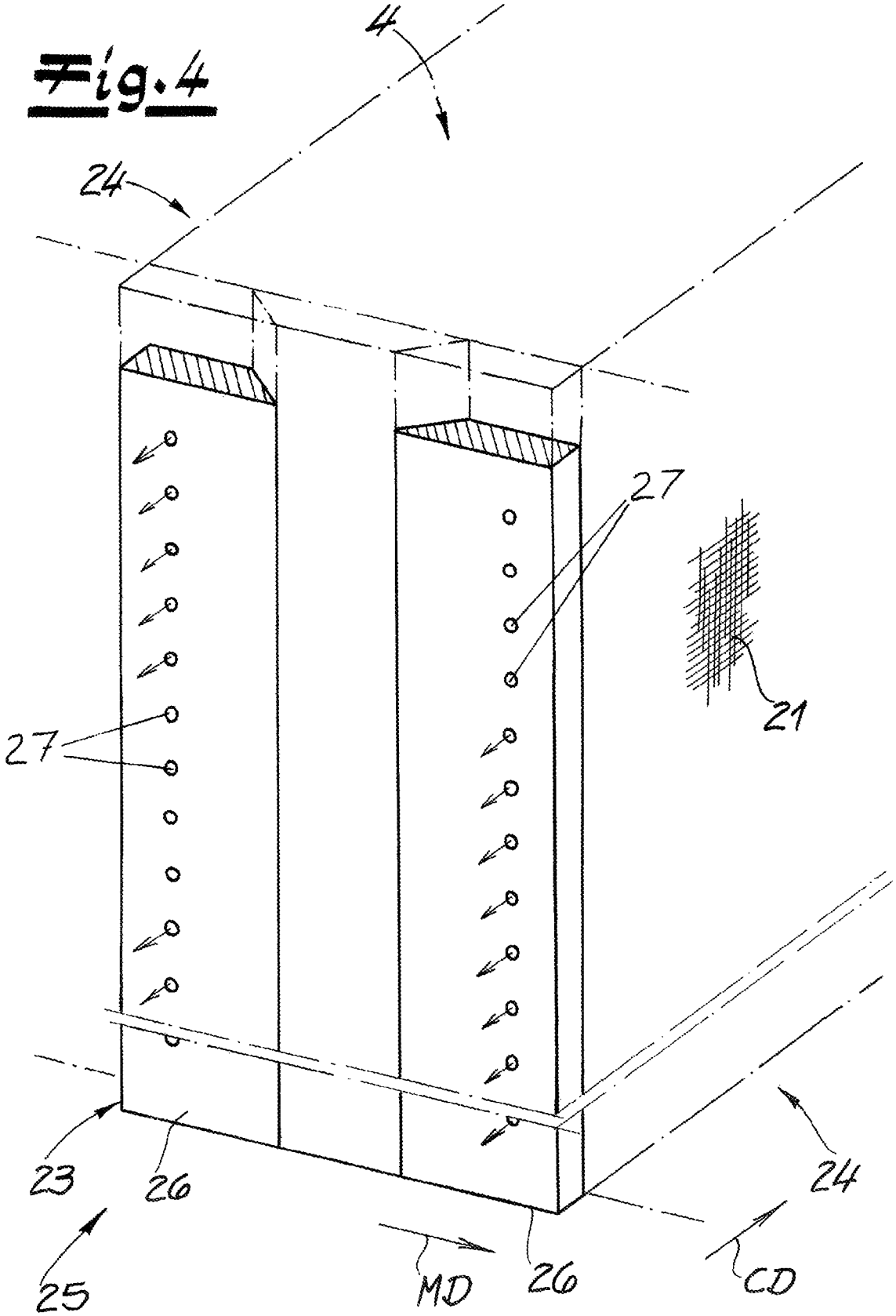
FIG. 4 is a perspective view of air-conducting elements on an MD/longitudinal side wall of the apparatus according to the invention.

FIGS. 2, 3 and 4 in particular illustrate the inventive extraction of cooling air through the MD/longitudinal side walls 25 of the cooling chamber 4. The cooling-air streams are extracted here transverse to the machine direction MD and thus in the CD direction or substantially in the CD direction. The directions of the flow vectors correspond to the arrows showing the cooling-air streams in the figures. As a result of the features of to the invention, the cooling air is given a preferred direction of flow (in the CD direction) here at the edges, is responsible for the advantages of the invention.

According to one embodiment of the invention, the cooling-air streams extracted through the two MD/longitudinal side walls 25 of the cooling chamber 4 can be set differently. As a result, disruptive manufacturing and assembly tolerances and/or different process air streams or monomer streams can be compensated for in order to achieve a homogeneous deposited nonwoven band. Apart from that, differences between the two edges of the deposited nonwoven band due to unevenness as a result of different heat input through the plastic melt or due to different per-hole throughputs on the spinneret or due to different mixing ratios can be compensated for.

FIG. 4 shows a preferred example of an embodiment of an MD/longitudinal side wall 25 of the cooling chamber 4 serving for inventive extraction of cooling air. Twenty-five angular air-conducting elements 26 that extend over the height of the cooling chamber 4 are provided here on the MD/longitudinal side walls. These air-conducting elements 26 form the edge profiles of the side-wall doors 23 in the embodiment. These air-conducting elements 26 have holes 27 that are distributed vertically along the height of the cooling chamber 4. The extraction of the cooling air on the MD/longitudinal side walls takes place via these holes 27 of the air-conducting elements 26. This extraction can occur passively due to an overpressure in the cooling chamber 4 and/or actively through active extraction of the cooling air, for example by an unillustrated blower. Preferably, extraction of the cooling air takes place over the entire height of the cooling chamber 4. It lies within the scope of the invention for the cooling-air streams that flow out through the holes 27 to be brought together in a conduit and/or in a chamber and regulated, for example by a gate valve. One embodiment is characterized in that the cooling air partial streams that are drawn off on both MD/longitudinal side walls 25 of the cooling chamber 4 are merged, for example in a chamber and/or conduit, and set and/or regulated together particularly using an actuator and/or regulator.

Figure 5:
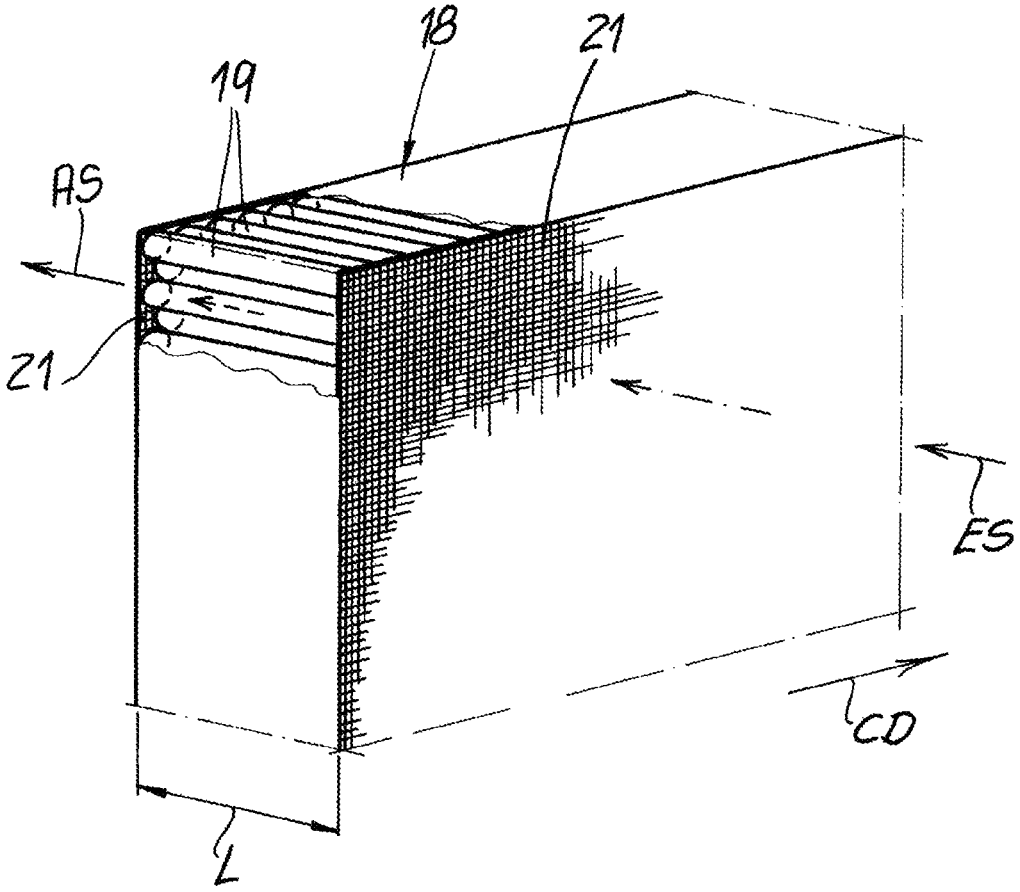
FIG. 5 is a perspective view of a subassembly of a flow straightener with upstream and downstream flow screens.

Special inventive significance is given to the combination of the cooling-air discharge through the MD/longitudinal side walls 25 of the cooling chamber 4 with the flow straighteners 18 provided in the air supply manifolds 5, 6 of the cooling chamber 4. The flow straighteners 18 extend over both compartments 16, 17 of each air supply manifold 5, 6. The flow straighteners 18 serve to rectify the cooling-air stream that is incident on the filaments 1. FIG. 5 shows a perspective view of a flow straightener 18 that is more preferably used in the context of the invention. Recommendably, this flow straightener 18 has a plurality of flow passages 19 that are oriented perpendicular to the filament flow FS. These flow passages 19 are advantageously each delimited by passage walls 20 and are preferably straight.

Figure 6:
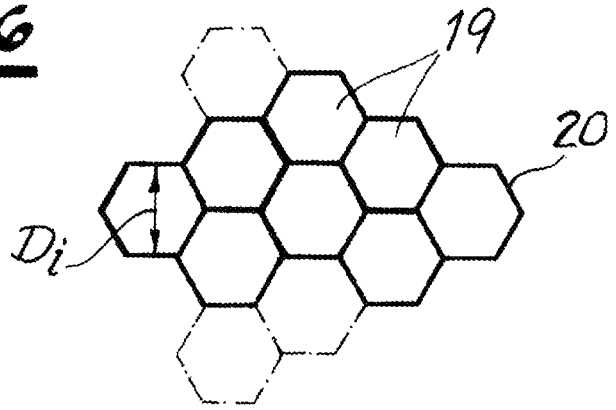
FIG. 6 is a cross section through part of a flow straightener.

According to a preferred embodiment, the free-flowable open surface area of each flow straightener 18 constitutes greater than 90% of the total area of the flow straightener 18. The ratio of a length L of the flow passages 19 to a smallest inner diameter $D_i$ of the flow passages 19 lies in the range between 1 and 10, advantageously in the range between 1 and 9. As an example and here according to FIG. 6, the flow passages 19 of a flow straightener 18 can have a hexagonal or honeycomb cross section. The smallest inner diameter $D_i$ is measured here between opposite side walls of the hexagon.

Recommendably, each flow straightener 18 has a flow screen 21 both on its cooling air inflow side wall ES and on its cooling air outflow side wall AS. The two flow screens 21 of each flow straightener 18 are provided directly upstream or downstream of the flow straightener 18. Recommendably, the two flow screens 21 of a flow straightener 18, more particularly the surfaces of these flow screens 21 are aligned perpendicular to the longitudinal direction of the flow passages 19 of the flow straightener 18. It has proven advantageous for the flow screen 21 to have mesh sizes of from 0.1 to 0.5 mm and preferably from 0.1 to 04 mm, as well as a wire thickness of from 0.05 to 0.35 and preferably from 0.05 to 0.32. It was demonstrated in the foregoing that, according to a preferred embodiment, the free-flowable open surface area of each flow straightener 18 constitutes greater than 90% of the total area of the flow straightener 18. The flow screens are not included in the calculation of the free-flowable open surface area of the flow straightener 18.

We claim:

1. An apparatus for making spunbonded nonwoven from continuous thermoplastic filaments, the apparatus comprising:

a spinneret for downwardly emitting the continuous filaments in a vertical direction;

a pair of vertical longitudinal side walls extending in a machine direction and a pair of vertical transverse side walls also extending transversely to the machine direction, bridging the longitudinal side walls, and forming therewith a cooling chamber directly beneath the spinneret for receiving the spun filaments from the spinneret and cooling the spun filaments with cooling air, each of the longitudinal and transverse walls being formed with a plurality of openings or gas-permeable regions;

respective air-supply manifolds on the transverse side walls for feeding cooling air therefrom through the openings or regions of the transverse side walls into the cooling chamber;

means for extracting air from the cooling chamber through the openings or regions of the longitudinal side walls;

a stretcher directly beneath the cooling chamber for receiving and elongating the cooled filaments; and a device for depositing the stretched filaments as a band and conveying the band off in the machine direction.

2. The apparatus defined in claim 1, wherein the manifolds feed the cooling air through the transverse side walls at superatmospheric pressure.

3. The apparatus defined in claim 1, wherein the means for extracting includes at least one blower.

4. The apparatus defined in claim 1, wherein the means for extracting through the longitudinal side walls extracts the cooling air at a rate of 1 to 400 $m^3/h$.

5. The apparatus defined in claim 1, further comprising:

an air-conducting element on at least one the longitudinal walls for guiding the extracted cooling air.

6. The apparatus defined in claim 5, wherein the at least one side wall is formed with a door having an edge profile forming the air-conducting element.

7. The apparatus defined in claim 1, further comprising:

a controller for regulating the feeding of cooling air into and the extraction of cooling air from the cooling chamber.

8. The apparatus defined in claim 1, further comprising:

a monomer extractor between the spinneret and the cooling chamber and conduit means for feeding cooling air extracted from least one longitudinal side wall of the cooling chamber into the monomer extractor.

9. The apparatus defined in claim 1, wherein the means extracts the cooling air at a rate in accordance with a sensed state of the filaments in the cooling chamber.

10. The apparatus defined in claim 9 wherein the cooling air is extracted by the means through both longitudinal side walls and at different rates.

11. The apparatus defined in claim 1, further comprising:

means for passing the cooling air extracted through at least one longitudinal side wall through a monomer extractor and then feeding the air from the extractor back into the chamber through at least one side wall.

* * * * *